US005932020A

United States Patent [19]

Murphy

[11] Patent Number: 5,932,020

[45] Date of Patent: Aug. 3, 1999

[54] METAL CLEANING COMPOSITION AND PROCESS THAT DO NOT DAMAGE PLASTIC

[75] Inventor: Donald P. Murphy, Rochester Hills, Mich.

[73] Assignee: Henkel Corporation, Gulph Mills, Pa.

[21] Appl. No.: 08/817,023

[22] PCT Filed: Aug. 8, 1995

[86] PCT No.: PCT/US95/09687

§ 371 Date: Apr. 8, 1997

§ 102(e) Date: Apr. 8, 1997

[87] PCT Pub. No.: WO97/06229

PCT Pub. Date: Feb. 20, 1997

[51] Int. Cl.[6] ..... C23G 1/02; C23G 5/00; B08B 3/08

[52] U.S. Cl. ..... 134/2; 134/3; 134/28; 134/29; 134/32; 134/34; 134/40; 134/41; 510/242; 510/274; 510/269

[58] Field of Search ..... 134/2, 3, 28, 29, 134/32, 34, 40, 41; 510/242, 274, 269

[56] References Cited

U.S. PATENT DOCUMENTS

| | | | |
|---|---|---|---|
| 2,273,300 | 2/1942 | Thatcher et al. | 101/235 |
| 3,717,590 | 2/1973 | Fetty | 252/540 |
| 3,725,224 | 4/1973 | Kendall | 204/141.5 |
| 4,705,665 | 11/1987 | Malik | 422/12 |
| 4,873,174 | 10/1989 | Dhillon et al. | 430/309 |
| 5,077,008 | 12/1991 | Kralovic et al. | 422/37 |

*Primary Examiner*—Zeinab El-Arini

*Attorney, Agent, or Firm*—Ernest G. Szoke; Wayne C. Jaeschke; Norvell E. Wisdom, Jr.

[57] ABSTRACT

An aqueous liquid composition containing dihydrogen phosphate salt, sulfur containing surfactant, and preferably a small amount of phosphoric acid cleans soiled metal surfaces without damaging any plastic parts that come into contact with the composition with the composition and without supporting the growth of bacteria that cause unpleasant odors. The composition is particularly useful for cleaning unpainted aluminum sided rail transport cars that have polycarbonate housings insulating electrical contact points that provide motive electric power to the cars; many conventional aqueous alkaline and acid cleaners promote stress cracking of polycarbonate plastics.

20 Claims, No Drawings

METAL CLEANING COMPOSITION AND PROCESS THAT DO NOT DAMAGE PLASTIC

This is a national stage application of PCT/US95/09687 filed Aug. 8, 1995.

BACKGROUND OF THE INVENTION

1. Field of the Invention

This invention relates to cleaning metal surfaces, both painted and unpainted, more particularly when the metal surfaces are adjacent to elements of plastic, especially polycarbonate plastic, which is susceptible to stress cracking when repeatedly contacted with many conventional metal cleaning compositions. This invention also relates to cleaning compositions that are useful in such cleaning processes, are not overly acidic or alkaline, and are not susceptible to developing undesirable odors from micro-organisms that readily come into contact with the compositions during normal storage or use.

2. Statement of Related Art

A very wide variety of cleaning compositions are known in the art. Few if any of these compositions, however, are known to be capable of fulfilling all the desiderata noted above, particularly for railroad cars that are powered by electricity. Such cars, like other railroad cars, come into contact with a wide variety of atmospheric pollutants and air-borne soils that often lead to rapid deterioration in the aesthetic appearance of the exteriors of the cars. Ordinary rail cars that do not supply their own motive power can be readily cleaned by a variety of cleaners, usually most readily by fairly highly alkaline cleaners. However, rail cars that are directly powered by electricity, a type especially frequently used in mass transit operations, generally have housings of polycarbonate plastic on their exterior surfaces to protect electrical contacts that supply power to move the cars from a "third rail", overhead power line, or the like. This plastic readily develops stress cracks when contacted repeatedly by many alkaline solutions, including some of the most generally effective aqueous metal cleaning compositions. Such large vehicles can most conveniently be cleaned by sprayers, but it is a practical impossibility in many cases to protect any plastic parts of the exterior surface from contact with a sprayed cleaner composition, and frequent replacements of the plastic insulating housings are economically unacceptable.

DESCRIPTION OF THE INVENTION

Object of the Invention

Major objects of the present invention are to provide compositions and/or processes that (i) effectively clean painted and unpainted metal surfaces, (ii) do not damage any plastic materials, particularly polycarbonate plastic insulating housings, that are adjacent to the metal surfaces to be cleaned, (iii) are not susceptible to becoming malodorous as a result of infestation from commonly ambient micro-organisms, and (iv) do not have a pH lower than about 3 or higher than about 9, so as to minimize the likelihood of personal injuries to workers using the cleaners. A subsidiary object is to brighten unpainted aluminum surfaces, particularly those of Type 6061 T6 aluminum, that are cleaned using the compositions. Other objects will be apparent from the description below.

General Principles of Description

Except in the claims and the specific examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, unless expressly stated to the contrary: percent, "parts of", and ratio values are by weight; the term "polymer" includes "oligomer", "copolymer", "terpolymer", and the like; the first definition or description of the meaning of a word, phrase, acronym, abbreviation or the like applies to all subsequent uses of the same word, phrase, acronym, abbreviation or the like and applies, mutatis mutandis, to normal grammatical variations thereof; the description of a group or class of materials as suitable or preferred for a given purpose in connection with the invention implies that mixtures of any two or more of the members of the group or class are equally suitable or preferred; chemical descriptions of neutral materials apply to the materials at the time of addition to any combination specified in the description and do not necessarily preclude chemical changes to the materials as a result of reaction in the combination; specification of materials in ionic form means that the materials are supplied to prepare the compositions containing them in the form of soluble salts containing the ions specified and implies the presence in any composition specified to contain ionic materials of sufficient counterions to produce electrical neutrality for the composition as a whole; and any counterions thus implicitly specified preferably are selected from among other constituents explicitly specified in ionic form, to the extent possible; otherwise such counterions may be freely selected, except for avoiding counterions that act adversely to the objects of the invention.

SUMMARY OF THE INVENTION

Liquid cleaning compositions according to the invention have a pH value between 3 and 9 and comprise, preferably consist essentially of, or more preferably consist of, water and:

(A) dihydrogen phosphate ions and (B) a component of surfactant(s), preferably resistant to attack by micro-organisms; and, optionally, one or more of:

(C) a component of acid(s) that are stronger acids than dihydrogen phosphate ions and that are not part of any of the preceding components;

(D) a component of antifoam agent(s), other than those that are part of any of the preceding components;

(E) odorants and/or colorants, other than those that are part of any of the preceding components.

These compositions according to the invention may either be working compositions, suitable for direct use in cleaning, or concentrate compositions, suitable for dilution with additional water to produce a working composition.

A process according to the invention comprises at least a step of contacting a soiled metal surface with a liquid cleaning composition according to the invention as defined herein and maintaining sufficient relative motion between the liquid cleaning composition and the soiled metal surface to remove some of the soil from the surface by dissolving and/or dispersing the soil in the liquid cleaning composition.

DETAILED DESCRIPTION OF THE INVENTION, INCLUDING PREFERRED EMBODIMENTS

Compositions according to the invention preferably have no evidence of phase stratification visible to unaided normal human vision; i.e., the compositions may be cloudy or otherwise show evidence of suspended second phases, but preferably do not stratify into more than one liquid layer or contain any solid particles large enough to see individually with unaided normal human vision. If this condition is not fulfilled, there is always some danger of concentration variations due to inhomogeneity of the composition.

The dihydrogen phosphate ions required for component (A) can be supplied by any soluble salt including such ions. For reasons of economy, ammonium, potassium, and sodium dihydrogen phosphates are preferred, with sodium most preferred. In a working cleaning composition according to the invention, the concentration of dihydrogen phosphate ions preferably is, with increasing preference in the order given, at least 1.7, 3.7, 5.7, 7.7, 9.7, 10.7, 11.7, 12.7, 13.7, 14.7, or 15.7 grams per liter (hereinafter usually abbreviated as "g/L") and independently preferably is, with increasing preference in the order given, not more than 100, 75, 50.8, 45.8, 40.8, 35.8, 30.8, 28.8, 26.8, 25.8, 24.8, or 23.8 g/L.

Surfactant component (B) is preferably selected from anionic surfactant molecules including at least one aromatic ring and at least one sulfur atom per molecule. More preferably, this component is selected from surfactant molecules including two phenyl rings, which still more preferably are each bonded by a single bond to a single oxygen atom. Independently, in order to minimize the chance of development of malodorous growths of micro-organisms in the compositions according to the invention, the surfactant molecules preferably contain, with increasing preference in the order given, at least 2, 4, 6, 7, 8, 9, or 10 percent of sulfur, most preferably in the form of at least one sulfonate group bonded to each phenyl ring in the molecule. Also, independently, the surfactants are preferably ammonium, potassium, or sodium salts, most preferably sodium salts. Another independent preference is that the average molecular weight of the surfactant component preferably is, with increasing preference in the order given, at least 200, 300, 400, 450, 500, 525, 550, or 575 and independently preferably is, with increasing preference in the order given, not more than 1500, 1000, 900, 800, 750, 700, 675, 650, or 625. The single most preferred chemical type for surfactant component (B) is sodium salts of disulfonated tetrapropylene derivatives of 1,1-oxy-bis-benzene, commercially available from Dow under the trade name DOWFAX™ 2A1.

The amount of surfactant component (B) in a working composition according to the invention preferably is at least, with increasing preference in the order given, 0.4, 0.8, 1.2, 1.6, 2.0, 2.2, 2.4, 2.6, 2.8, 3.0, or 3.2 g/L and independently preferably is, with increasing preference in the order given, not more than 15, 12, 10, 9.2, 8.2, 7.2, 6.2, 5.7, 5.3, 5.0, or 4.8 g/L. Independently, in either a concentrate or a working composition according to the invention, the ratio of the amount of surfactant component (B) to the amount of dihydrogen phosphate ions component (A) preferably is at least, with increasing preference in the order given, 0.05:1.0, 0.10:1.0, 0.13:1.0, 0.15:1.0, 0.16:1.0, 0.17: 1.0, 0.18:1.0, 0.19:1.0, or 0.20:1.0 and independently preferably is not more than, with increasing preference in the order given, 0.50:1.0, 0.40:1.0, 0.35:1.0, 0.33:1.0, 0.31:1.0, 0.29:1.0, 0.27:1.0, 0.25:1.0, 0.24:1.0, 0.23:1.0, 0.22:1.0, or 0.21:1.0.

The presence of optional component (C) in a composition according to the invention is normally preferred, especially when the metal surface to be cleaned is unpainted and a brightening effect on the cleaned surface is desired. Within the broadest scope of the invention, any acidic material that is a stronger acid than dihydrogen phosphate ions may be used for component (C). However, organic acids are generally less preferred, because they appear to be more likely to cause stress cracking of polycarbonate plastics than inorganic acids. The single most preferred material for component (C) is orthophosphoric acid. For any particular chemical substance in component (C), the "effective number of acid hydrogen atoms per molecule" is hereby defined as the number of hydrogen atoms per molecule of the substance that are formed by ionization, in a composition according to the invention, by a reaction with a higher ion product constant than that, in the same composition according to the invention, for the reaction: $H_2PO_4^- \leftrightharpoons HPO_4^{-2} + H^+$. Also, the "effective moles of acid" (hereinafter usually abbreviated "EMA") for any particular amount of a component (C) according to this invention with a particular composition consisting of n distinct chemical substances, where n represents a positive integer, each of said distinct chemical substances having an effective number of acid hydrogen atoms per molecule of $e_i$, where i represents an integer from 1 to n that denotes the i'th substance in the number of distinct chemical substances, each of said distinct chemical substances being present in a number of moles $m_i$, is defined for later use herein by equation (1) below:

$$EMA = \sum_{i=1}^{n} m_i \cdot e_i. \tag{1}$$

Independently of the chemical nature of the acid, the amount of component (C) in a composition according to the invention preferably is such that the ratio of the EMA of component (C) to the number of moles of dihydrogen phosphate ions in component (A) present along with component (C) in a composition according to the invention preferably is at least, with increasing preference in the order given, 0.005:1.0, 0.015:1.0, 0.025:1.0, 0.035:1.0, 0.045:1.0, 0.050:1.0, 0.055:1.0, 0.057:1.0, 0.059:1.0, 0.061:1.0, 0.063:1.0, or 0.065:1.0 and independently preferably is not more than, with increasing preference in the order given, 0.40:1.0, 0.30:1.0, 0.20:1.0, 0.15:1.0, 0.10:1.0, 0.090:1.0, 0.085:1.0, 0.080:1.0, 0.075:1.0, 0.070:1.0, or 0.067:1.0.

Ordinarily, antifoam component (D) is not needed in a composition according to this invention, because most such compositions with preferred ingredients in preferred amounts have not been observed to be prone to excessive foaming. If antifoaming agent should be needed, the most effective ones tested have been found to be PARCOLENE® 95B concentrate, P3® Defoamer 2483, and PARCO® Defoamer 14, all available commercially from the Parker Amchem Div. of Henkel Corp., Madison Heights, Mich., USA and FOAM BAN™ MS-30, commercially available from Ultra Additives, Inc., Paterson, N.J.

Component (E) is not normally required for any technical reason, but may be aesthetically advantageous for certain uses of compositions according to the invention.

For various reasons, it is often preferred that many ingredients used in other cleaning compositions should not be present in compositions according to the invention. Specifically, it is increasingly preferred in the order given, independently for each preferably minimized type of material listed below, that compositions according to the invention contain no more than 10, 5,3, 2.0, 1.0, 0.60, 0.35, 0.10, 0.08, 0.04, 0.02, 0.01, 0.005, 0.002, or 0.001 percent of each of the following materials: alkali metal, alkaline earth metal, and ammonium hydroxides, monohydrogen phosphates, phosphates, condensed phosphates, and sulfates; any chemical form of any metals other than alkali and alkaline earth metals; nitrates and other oxidizing agents (the others being measured as their oxidizing stoichiometric equivalent as nitrate) that are not part of one of the necessary or optional components of compositions according to the invention as described above; alcohols, ethers, ether alcohols, hydrocarbons, halocarbons, halohydrocarbons, aldehydes, or ketones that are not part of one of the necessary or optional components of compositions according to the invention as described above; and silicates and oxides of silicon.

Independently of the other preferences stated above, a working composition according to the invention preferably has a pH value that is at least, with increasing preference in the order given, 3.1, 3.3, 3.5, 3.6, 3.7, 3.8, 3.9, or 4.0 and independently preferably is, with increasing preference in the order given, not more than 8, 7, 6.5, 6.0, 5.8, 5.6, 5.4, 5.3, 5.2, 5.1, or 5.0.

A process according to the invention normally, primarily for convenience, is preferably performed at whatever ambient temperature is naturally prevailing, provided that this temperature is not too low for the cleaning composition used to remain liquid. Preferably, the cleaning composition is used at a temperature of at least, with increasing preference in the order given, 10, 15, 20, 25, or 30° C. Cleaning effectiveness generally increases with increasing temperature of use, up to at least 50° C. Preferably, the use temperature is not more than 55° C.

A concentrate composition according to the invention contains at least components (A) and (B) as described above and preferably also contains component (C) when the latter is desired in the working composition(s) to be made from the concentrate. More preferably, a concentrate composition according to the invention contains all of the components of a working composition according to the invention that are identified by letter above and are desired in the working composition(s) to be made from the concentrate composition. Independently of all other preferences with respect to concentrates, the concentration in a concentrate of any component of compositions according to the invention that is identified by letter above preferably is not less than, with increasing preference in the order given, 2, 3, 4, 5, 6, 7, 8, 9, or 10 times larger than any preferred concentration specified above for the same component in working compositions and independently preferably is, with increasing preference in the order given, not more than 50, 40, 35, 30, 25, 20, 17, 15, 13, or 11 times larger than any preferred concentration specified above for the same component in working compositions.

The invention is explained in greater detail below using working examples, and the benefits of the invention are illustrated by comparative examples.

EXAMPLES AND COMPARISON EXAMPLES

Group 1

Four possible cleaner compositions, as shown in Table 1.1 below, were made in concentrate form. A 5% by volume solution in water of each of Concentrates 1.2–1.4 and of sodium hydroxide were made to test for evidence of damage to polycarbonate plastic. Large electrical connectors with insulating blue polycarbonate plastic housings as actually used by the Bay Area Rapid Transit System in Northern California were tested by soaking in these potential working compositions, maintained at normal ambient temperatures from 20–25° C. for the times and with the results shown in Table 1.2 below. Concentrates 1.1, 1.3, and 1.4 are according to the invention and Concentrate 1.2 is not, because it lacks dihydrogen phosphate ions. Concentrate 1.1 is less preferred because of its spontaneous phase stratification.

TABLE 1.1

CONCENTRATES FOR GROUP 1

| Ingredient | % of Ingredient in Concentrate Number: 1.1 | 1.2 | 1.3 | 1.4 |
|---|---|---|---|---|
| Water | 47 | 34 | 77.4 | 77 |
| Sodium Dihydrogen Phosphate | 47 | 0 | 16 | 17 |
| Gluconic Acid | 0 | 60 | 0 | 0 |
| DOWFAX ™ 2A1 Surfactant* | 6 | 6 | 6 | 6 |
| Pine Oil (odorant) | 0 | 0 | 0.6 | 0 |
| Visible Phase Stratification? | Yes | No | No | No |

Footnote for Table 1.1
*This material is reported by its supplier to be an aqueous solution containing about 47% of its surfactant ingredients, which are benzene, 1,1-oxybis, tetrapropylene derivative, disulfonated, sodium salts.

TABLE 1.2

EFFECT OF WORKING COMPOSITIONS ON POLYCARBONATE

| Test Working Composition Made From: | Effect on Polycarbonate after Exposure for: 94 Hours | 142 hours |
|---|---|---|
| Sodium Hydroxide | Severely cracked | Not further tested |
| Concentrate 1.2 | Slightly cracked | Not further tested |
| Concentrate 1.3 | No cracking visible | No cracking visible |
| Concentrate 1.4 | No cracking visible | No cracking visible |

Group 2—Foam Testing of Compositions Containing Antifoam Agents

A concentrate composition according to the invention prepared for the purposes of these tests had the ingredients and concentrations specified in Table 2.1 below.

TABLE 2.1

CONCENTRATE COMPOSITION FOR GROUP 2

| Ingredient | Grams of Ingredient per Kilogram of Concentrate Composition |
|---|---|
| Tap Water | 756 |
| Anhydrous Sodium Dihydrogen Phosphate | 170 |
| 75% Aqueous Orthophosphoric Acid | 14 |
| DOWFAX ™ 2A1 Surfactant | 60 |

Ordinarily, this concentrate would be used at 5–20% by volume to make working cleaning compositions according to the invention. However, for purposes of this testing, 1% by volume solutions were used instead, to exaggerate the foaming tendency, which is stronger in more dilute solutions.

The general procedure for antifoam testing was as follows: Three (3) milliliters (hereinafter usually abbreviated "mL") of the concentrate was diluted to 300 mL with cold tap water and shaken in a stopperred mixing cylinder with 500 mL capacity to generate foam. Five (5) drops of the antifoam agent being tested were then added, and the mixture shaken again. If adequate defoaming was achieved by this addition of 5 drops of antifoam agent, enough additional antifoam agent to produce a total concentration of 1% by volume of the antifoam agent in the mixture was then added to the mixture to check for any phase stratification or other evidence of inhomogeneity. If 5 drops of defoamer were not sufficient, additional drops were added until adequate defoaming had been achieved, or until the amount of antifoam agent reached 0.25%. If adequate defoaming had been achieved with less than 0.25% by volume of antifoam agent in the total mixture, enough antifoam agent to bring its concentration to 1% was then added to check for any phase stratification or other evidence of inhomogeneity.

The antifoam agents tested are shown in Table 2.2, and the foam testing results, keyed to the identifying numbers given in Table 2.2, are described below after the Table.

TABLE 2.2

ANTIFOAM AGENTS TESTED

| Trade Name of Antifoam Agent | Supplier of Antifoam Agent | No. |
|---|---|---|
| PARCO ® Defoamer 14 | Parker Amchem Div. of Henkel Corp. | 1 |
| P3 ® Defoamer 2483 | Parker Amchem Div. of Henkel Corp. | 2 |
| 10% Aqueous Solution of FOAM BAN ™ MS-575 | Ultra Additives, Inc., Paterson, NJ | 3 |
| PARCOLENE ® 95B | Parker Amchem Div. of Henkel Corp. | 4 |
| ANTAROX ™ LF-222 | Rhône-Poulenc | 5 |
| PLURONIC ™ L-61 | Rhône-Poulenc | 6 |
| BEVELOID ™ 6244 | Rhône-Poulenc | 7 |
| FOAM BAN ™ MS-30 | Ultra Additives, Inc., Paterson, NJ | 8 |

Test Results:

1. Good defoaming with 5 drops. Raising antifoam agent to 1% produced scum floating on the surface and made the bulk of the liquid opaque.
2. Good defoaming with 5 drops, better than with antifoam agent 1. Raising antifoam agent to 1% produced white solid scum floating on the surface and made the bulk of the liquid translucent.
3. Good defoaming requires 8 drops. Raising antifoam agent to 1% did not produce any visible phase stratification, and the liquid remained clear.
4. Very good defoaming with 5 drops, even better than antifoam agent 2. Raising antifoam agent to 1% produced a small oily spot floating on the surface and made the bulk of the liquid substantially opaque.
5. Little or no defoaming effect even at 0.25%.
6. Little or no defoaming effect even at 0.25%.
7. Good defoaming required 8 drops. Raising antifoam agent to 1% produced a slight scum floating on the surface.
8. Very good defoaming with 5 drops. Raising antifoam agent to 1% made the bulk of the liquid translucent, but there was no evidence of phase stratification.

The invention claimed is:

1. A process of cleaning a painted, unpainted, or both painted and unpainted soiled metal surface that is in a fixed spatial position with respect to at least one plastic surface, by contacting the soiled metal surface with an aqueous liquid cleaning composition and maintaining relative motion between the liquid cleaning composition and the soiled metal surface to remove at least some of the soil from the metal surface by dissolving, dispersing, or both dissolving and dispersing the soil in the liquid cleaning composition, the contacting of the soiled metal surface being by a method that also results in contacting at least part of the plastic surface with respect to which the soiled metal surface is in a fixed spatial position without damaging the part of the plastic surface so contacted, wherein the aqueous liquid cleaning composition has a pH value in the range from about 3 to about 9 and consists essentially of water; and:

(A) dihydrogen phosphate ions and (B) a surfactant component that is selected from the group consisting of surfactants that are resistant to attack by micro-organisms; and optionally, one or more of:

(C) an acid component selected from the group consisting of acids that are stronger acids than dihydrogen phosphate ions and that are not part of any of the preceding components;

(D) a component of antifoam agent(s), other than those that are part of the preceding components;

(E) odorants, colorants, or both odorants and colorants, other than those that are part of any of the preceding components, the ratio of the amount of component (B) to the amount of component (A) being from about 0.05:1.0 to about 0.5:1.0.

2. A process according to claim 1, wherein the aqueous cleaning composition consists essentially of water and:

(A) from about 1.7 to about 50.8 g/L of dihydrogen phosphate ions; and (B) from about 0.4 to about 12 g/L of a surfactant component selected from the group consisting of surfactant molecules including at least one aromatic ring and at least one sulfur atom per molecule; and optionally, one or more of:

(C) an acid component selected from the group consisting of acids that are stronger acids than dihydrogen phosphate ions and that are not part of any of the preceding components;

(D) a component of antifoam agent(s), other than those that are part of any of the preceding components;

(E) odorants, colorants, or both odorants and colorants, other than those that are part of any of the preceding components.

3. A process according to claim 2, wherein, in the aqueous liquid cleaning composition, (i) the amount of component (A) is from about 3.7 to about 45.8 g/L, (ii) the amount of component (B) is from about 0.8 to about 8.2 g/L, and (iii) the ratio of the amount of component (B) to the amount of component (A) is from about 0.10:1.0 to about 0.40:1.0.

4. A process according to claim 3, wherein the aqueous cleaning composition consists essentially of water and:

(A) from about 5.7 to about 40.8 g/L of dihydrogen phosphate ions;

(B) from about 1.2 to about 7.2 g/L of a surfactant component selected from the group consisting of surfactant molecules including at least two phenyl rings per molecule and at least 4% by weight of sulfur; and (C) an acid component selected from the group consisting of acids that are stronger acids than dihydrogen phosphate ions and that are not part of any of the preceding components; and optionally, one or more of:

(D) a component of antifoam agent(s), other than those that are part of any of the preceding components;

(E) odorants, colorants, or both odorants and colorants, other than those that are part of any of the preceding components, wherein the ratio of the amount of component (B) to the amount of component (A) is from about 0.13:1.0 to about 0.35:1.0 and the ratio of the effective moles of acid in component (C) to the number of moles of component (A) is from about 0.015:1.0 to about 0.35:1.0.

5. A process according to claim 4, wherein, in the aqueous liquid cleaning composition, (i) the amount of component (A) is from about 7.7 to about 35.8 g/L, (ii) the amount of component (B) is from about 1.6 to about 6.2 g/L, (iii) the ratio of the amount of component (B) to the amount of component (A) is from about 0.15:1.0 to about 0.33:1.0, and (iv) the ratio of the effective moles of acid in component (C) to the number of moles of component (A) is from about 0.025:1.0 to about 0.15:1.0.

6. A process according to claim 5, wherein the aqueous cleaning composition consists essentially of water and:

(A) from about 9.7 to about 30.8 g/L of dihydrogen phosphate ions;

(B) from about 2.0 to about 5.7 g/L of a surfactant component selected from the group consisting of surfactant molecules including at least two phenyl rings per molecule and at least 6% by weight of sulfur; and (C) an acid component selected from the group consisting of acids that are stronger acids than dihydrogen phosphate ions and that are not part of any of the preceding components; and optionally, one or more of:

(D) a component of antifoam agent(s), other than those that are part of any of the preceding components;

(E) odorants, colorants, or both odorants and colorants, other than those that are part of any of the preceding components, wherein the ratio of the amount of component (B) to the amount of component (A) is from about 0.16:1.0 to about 0.31:1.0 and the ratio of the effective moles of acid in component (C) to the number of moles of component (A) is from about 0.035:1.0 to about 0.10:1.0.

7. A process according to claim 6, wherein, in the aqueous liquid cleaning composition, (i) the amount of component (A) is from about 10.7 to about 28.8 g/L, (ii) the amount of component (B) is from about 2.2 to about 5.3 g/L, (iii) the ratio of the amount of component (B) to the amount of component (A) is from about 0.17:1.0 to about 0.29:1.0, and (iv) the ratio of the effective moles of acid in component (C) to the number of moles of component (A) is from about 0.045:1.0 to about 0.090:1.0.

8. A process according to claim 7, wherein the aqueous cleaning composition consists essentially of water and:

(A) from about 11.7 to about 26.8 g/L of dihydrogen phosphate ions;

(B) from about 2.4 to about 5.1 g/L of a surfactant component selected from the group consisting of surfactant molecules including at least two phenyl rings, each bonded directly to a single oxygen atom, per molecule and at least 7% by weight of sulfur in the form of a sulfonate moiety bonded to each phenyl ring in the molecule; and (C) an acid component selected from the group consisting of acids that are stronger acids than dihydrogen phosphate ions and that are not part of any of the preceding components; and optionally, one or more of:

(D) a component of antifoam agent(s), other than those that are part of any of the preceding components;

(E) odorants, colorants, or both odorants and colorants, other than those that are part of any of the preceding components.

9. A process according to claim 8, wherein, in the aqueous liquid cleaning composition, (i) the amount of component (A) is from about 12.7 to about 25.8 g/L, (ii) the amount of component (B) is from about 2.6 to about 5.1 g/L, (iii) the ratio of the amount of component (B) to the amount of component (A) is from about 0.18:1.0 to about 0.27:1.0, and (iv) the ratio of the effective moles of acid in component (C) to the number of moles of component (A) is from about 0.050:1.0 to about 0.085:1.0.

10. A process according to claim 5, wherein the aqueous cleaning composition consists essentially of water and:

(A) from about 13.7 to about 24.8 g/L of dihydrogen phosphate ions;

(B) from about 2.8 to about 4.8 g/L of a surfactant component selected from the group consisting of surfactant molecules having a molecular weight in the range from about 400 to about 800 and including at least two phenyl rings, each directly bonded to a single oxygen atom, per molecule and at least 8% by weight of sulfur in the form of a sulfonate moiety bonded to each phenyl ring in the molecule; and (C) orthophosphoric acid; and optionally, one or more of:

(D) a component of antifoam agent(s), other than those that are part of any of the preceding components;

(E) odorants, colorants, or both odorants and colorants, other than those that are part of any of the preceding components.

11. A process according to claim 10, wherein, in the aqueous liquid cleaning composition, (i) the amount of component (A) is from about 15.7 to about 23.8 g/L, (ii) the amount of component (B) is from about 3.2 to about 4.8 g/L, (iii) the ratio of the amount of component (B) to the amount of component (A) is from about 0.19:1.0 to about 0.22:1.0, (iv) the ratio of the effective moles of acid in component (C) to the number of moles of component (A) is from about 0.059:1.0 to about 0.080:1.0, and (v) component (B) is selected from molecules which have a molecular weight from about 550 to about 650 and contain at least about 9% of sulfur.

12. A concentrate composition useful for preparing an aqueous liquid composition for use in a process according to claim 1 by dilution with water, said concentrate composition consisting essentially of water and:

(A) from about 10.4 to about 200 g/L of dihydrogen phosphate ions;

(B) from about 2.4 to about 72 g/L of a surfactant component selected from the group consisting of anionic surfactant molecules including at least two phenyl rings per molecule and at least 4% by weight of sulfur; and (C) an acid component selected from the group consisting of acids that are stronger acids than dihydrogen phosphate ions and that are not part of any of the preceding components; and optionally, one or more of:

(D) a component of antifoam agent(s), other than those that are part of any of the preceding components;

(E) odorants, colorants, or both odorants and colorants, other than those that are part of any of the preceding components, wherein the ratio of the amount of component (B) to the amount of component (A) is from about 0.13:1.0 to about 0.35:1.0 and the ratio of the effective moles of acid in component (C) to the number of moles of component (A) is from about 0.015:1.0 to about 0.30:1.0.

13. A concentrate composition according to claim 12, wherein (i) the amount of component (A) is from about 30.8 to about 180 g/L, (ii) the amount of component (B) is from about 5.4 to about 60 g/L, (iii) the ratio of the amount of component (B) to the amount of component (A) is from about 0.15:1.0 to about 0.33:1.0, and (iv) the ratio of the effective moles of acid in component (C) to the number of moles of component (A) is from about 0.025:1.0 to about 0.15:1.0.

14. A concentrate composition according to claim 13, consisting essentially of water and:

(A) from about 58.2 to about 170 g/L of dihydrogen phosphate ions;

(B) from about 5.0 to about 50 g/L of a surfactant component selected from the group consisting of surfactant molecules including at least two phenyl rings per molecule and at least 6% by weight of sulfur; and (C) an acid component selected from the group consisting of acids that are stronger acids than dihydrogen phosphate ions and that are not part of any of the preceding components; and optionally, one or more of:

(D) a component of antifoam agent(s), other than those that are part of any of the preceding components;

(E) odorants, colorants, or both odorants and colorants, other than those that are part of any of the preceding components, wherein the ratio of the amount of component (B) to the amount of component (A) is from about 0.16:1.0 to about 0.31:1.0 and the ratio of the effective moles of acid in component (C) to the number of moles of component (A) is from about 0.035:1.0 to about 0.10:1.0.

15. A concentrate composition according to claim 14, wherein (i) the amount of component (A) is from about 60 to about 170 g/L, (ii) the amount of component (B) is from about 13.2 to about 52 g/L, (iii) the ratio of the amount of component (B) to the amount of component (A) is from about 0.17:1.0 to about 0.29:1.0, and (iv) the ratio of the effective moles of acid in component (C) to the number of moles of component (A) is from about 0.045:1.0 to about 0.090:1.0.

16. A concentrate composition according to claim 15, wherein the aqueous cleaning composition consists essentially of water and:

(A) from about 77 to about 170 g/L of dihydrogen phosphate ions;

(B) from about 15 to about 49 g/L of a surfactant component selected from the group consisting of surfactant molecules including at least two phenyl rings, each bonded directly to a single oxygen atom, per molecule and at least 7% by weight of sulfur in the form of a sulfonate moiety bonded to each phenyl ring in the molecule; and (C) an acid component selected from the group consisting of acids that are stronger acids than dihydrogen phosphate ions and that are not part of any of the preceding components; and optionally, one or more of:

(D) a component of antifoam agent(s), other than those that are part of any of the preceding components;

(E) odorants, colorants, or both odorants and colorants, other than those that are part of any of the preceding components.

17. A concentrate composition according to claim 16, wherein (i) the amount of component (A) is from about 127 to about 165 g/L, (ii) the amount of component (B) is from about 18 to about 44 g/L, (iii) the ratio of the amount of component (B) to the amount of component (A) is from about 0.18:1.0 to about 0.27:1.0, and (iv) the ratio of the effective moles of acid in component (C) to the number of moles of component (A) is from about 0.050:1.0 to about 0.085:1.0.

18. A concentrate composition according to claim 17, consisting essentially of water and:

(A) from about 137 to about 165 g/L of dihydrogen phosphate ions;

(B) from about 24 to about 44 g/L of a surfactant component selected from the group consisting of surfactant molecules having a molecular weight in the range from about 400 to about 800 and including at least two phenyl rings, each directly bonded to a single oxygen atom, per molecule and at least 8% by weight of sulfur in the form of a sulfonate moiety bonded to each phenyl ring in the molecule; and (C) orthophosphoric acid; and optionally, one or more of:

(D) a component of antifoam agent(s), other than those that are part of any of the preceding components;

(E) odorants, colorants, or both odorants and colorants, other than those that are part of any of the preceding components.

19. A concentrate composition according to claim 18, wherein (i) the amount of component (A) is from about 147 to about 165 g/L, (ii) the amount of component (B) is from about 28 to about 36 g/L, (iii) the ratio of the amount of component (B) to the amount of component (A) is from about 0.19:1.0 to about 0.22:1.0, (iv) the ratio of the effective moles of acid in component (C) to the number of moles of component (A) is from about 0.059:1.0 to about 0.080:1.0, and (v) component (B) is selected from molecules which have a molecular weight from about 550 to about 650 and contain at least about 9% of sulfur.

20. A concentrate composition according to claim 19, wherein component (B) is selected from sodium salts of disulfonated tetrapropylene derivatives of 1,1-oxybisbenzene.

* * * * *